US005594482A

United States Patent [19]

Ohashi

[11] Patent Number: 5,594,482

[45] Date of Patent: Jan. 14, 1997

[54] INK JET PRINTER HEAD WITH INK CHANNEL PROTECTIVE FILM

[75] Inventor: Yumiko Ohashi, Hashima, Japan

[73] Assignee: Brother Kogyo Kabushiki Kaisha, Nagoya, Japan

[21] Appl. No.: 153,098

[22] Filed: Nov. 17, 1993

[30] Foreign Application Priority Data

Feb. 26, 1993 [JP] Japan ..... 5-037880

[51] Int. Cl.[6] ..... B41J 2/045

[52] U.S. Cl. ..... 347/69

[58] Field of Search ..... 347/45, 64, 68, 347/69

[56] References Cited

U.S. PATENT DOCUMENTS 4,879,568 11/1989 Bartky et al. ..... 346/140 R
4,887,100 12/1989 Michaelis et al. ..... 346/140 R
4,968,992 11/1990 Komuro ..... 346/1.1
5,016,028 5/1991 Temple ..... 346/140 R
5,028,936 7/1991 Bartky et al. ..... 346/140 R
5,245,244 9/1993 Takahashi et al. ..... 347/69 X

FOREIGN PATENT DOCUMENTS 5-269984 10/1993 Japan ..... B41J 2/045
92/22429 12/1992 WIPO ..... B41J 2/045

*Primary Examiner*—Alrick Bobb
*Attorney, Agent, or Firm*—Oliff & Berridge

[57] ABSTRACT

An ink jet printer head has a piezoelectric ceramic element with a plurality of ink reservoirs wherein at least one side wall of each reservoir is made of a piezoelectric ceramic material and has an electrode for driving the piezoelectric ceramic element formed on the wall. The electrode is covered with an inorganic passive state protective film, and the protective film has a thickness of from 0.1 μm to a value smaller than ⅛ of a thickness of the wall in maximum or a density of not smaller than 1.8 g/cm$^3$. The protective film may be formed to cover all inner surfaces of each reservoir.

12 Claims, 7 Drawing Sheets

PRIOR ART

PRIOR ART

INK JET PRINTER HEAD WITH INK CHANNEL PROTECTIVE FILM

BACKGROUND OF THE INVENTION

1. Field of the Invention

This invention relates to an ink jet printer head of the type having ink reservoirs wherein at least one of the walls of each reservoir is made of a piezoelectric ceramic material and is activated by an electrode.

2. Description of the Related Art

Ink jet devices making use of piezoelectric ceramic elements are known and have been hitherto proposed including, for example, drop-on-demand type ink jet devices. The device is arranged so that a piezoelectric ceramic element has a number of grooves, each individual grooves having the capacity to deform due to the piezoelectric ceramic material. When the capacity or volume of a groove is reduced, ink in the groove is jetted from a corresponding nozzle in the form of droplets. When the capacity is increased, the ink is introduced from an ink introducing pipe into the groove. A multitude of nozzles are provided adjacent to one another, so that when ink droplets are jetted from given nozzles according to given printing information, a desired letter or image is formed on a paper sheet provided in face-to-face relation with the nozzles.

Referring to FIG. 1, a known ink jet device is shown. The device includes a piezoelectric ceramic element 1 having a plurality of grooves 12 wherein the element 1 is polarized in the direction of arrow 4. The device also includes a cover plate 2 made of a ceramic or resin material bonded with the element 1 through a bonding layer 3 such as an epoxy adhesive, thus defining the plurality of grooves 12 as ink passages. Individual ink passages have an elongated shape with a rectangular section and each includes side walls 11 extending over the entire length of the ink passage. The side walls 11 are formed with a metal electrode 13, to which a drive electric field is applied, on opposite surfaces thereof extending from the top of the side wall in the vicinity of the adhesive layer 3 at the apex of the side wall 11 toward the central portion of the side wall 11. Each electrode 13 is covered with a protective film 20 as shown. Ink is filled in all of the ink passages during operation.

The operation of the device is illustrated with reference to FIG. 2, which is a sectional view of an ink jet device. In the ink jet device, if a groove 12 is, for example, selected according to given printing information, a positive drive potential is quickly applied between the metal electrodes 13*e* and 13*f*, and metal electrodes 13*d* and 13*g* are connected to ground. By this arrangement, a drive electric field acts on the side wall 11*b* along the direction of arrow 14*b* and on the side wall 11*c* along the direction of arrow 14*c*. Since the drive electric fields 14*b* and 14*c* are crossed at right angles with respect to the direction 4 of polarization, the side walls 11*b*, 11*c* are rapidly deformed in the direction of inside of the groove 12*b* owing to the piezoelectric perpendicular slide effect. The deformation contributes to the reduction in capacity of the groove 12*b*, leading to the quick increase of pressure exerted on an ink. This eventually generates a pressure wave in the groove 12*b*, so that ink droplets are jetted from a nozzle 32 of FIG. 3 in communication with the groove 12*b*. If the application of the drive potential is gradually stopped, the side walls 11*b* and 11*c* are returned to the respective positions prior to the deformation, and, thus, the ink pressure within the groove 12*b* is lowered. Accordingly, fresh ink is supplied from an ink inlet port 21 of FIG. 3 through a manifold 22 into the groove 12*b*.

In conventional ink jet devices, a drive potential may be applied, prior to the jetting operation, in a reverse direction as described above to initially supply the ink. Subsequently, the drive potential is abruptly stopped, by which the side walls 11*b*, 11*c* are, respectively, returned to the original positions thereof, thereby causing the ink to be jetted.

Next, reference is made to FIG. 3 showing a perspective view of an ink jet device to illustrate arrangement and fabrication of the known device. The piezoelectric ceramic element 1 is formed with grooves 12 according to cutting by a thin disk-shaped diamond blade or the like. The grooves 12 are arranged parallel to one another and have substantially the same depth throughout the piezoelectric ceramic element 1 but are gradually smaller in depth as they approach opposite end faces 15. In the vicinity of the end faces 15, a shallow, parallel groove portion 16 is provided. The metal electrodes 13 are formed on the inner side walls of each groove 12 according to known techniques such as sputtering. The protective layer 20 is formed on the inner surfaces of the grooves 12 by a dry or wet method so as to cover the electrodes 13 therewith.

A cover plate 2 made of a ceramic or resin material is subjected to grinding or cutting to make an ink introducing port 21 and a manifold 22. The piezoelectric ceramic element 1 and the cover plate 2 are bonded by an epoxy adhesive or the like such that the side of the element 1 having the grooves 12 and the side of the plate 2 having the manifold are facing each other. A nozzle plate 31 having nozzles 32 provided in correspondence with the respective grooves 12 is bonded at one end face of the piezoelectric ceramic element 1 and the cover plate 2. A substrate 41 having a pattern 42 of conductive layers positioned to correspond to the respective grooves 12 is bonded, preferably by an epoxy adhesive, to a side opposite to the groove 12, or the bearing side of the element 1. Metal electrodes 13 formed at the bottom of each shallow groove portion 16 of the grooves 12 are connected to the pattern 42 of conductive layers through conductive wires 43 through wiring bonding.

Referring to FIG. 4, a block diagram of a known control unit is shown to illustrate an arrangement of the control unit. The conductive layers of the pattern 42 on the substrate 41 are individually connected to an LSI chip 51, and a clock line 52, a data line 53, a voltage line 54 and a ground line 55 are, respectively, connected to the LSI chip 51. The LSI chip 51 determines which nozzles are used to jet ink droplets based on data appearing on the data line 53 on the basis of on a continuous clock pulse passed from the clock line 52. Then, a voltage V of the potential line 54 is applied to selected conductive layers of the pattern 42 connected to the corresponding metal electrodes 13 of the grooves 12 to be driven. At the same time, conductive layers of the pattern 42 connected to the metal electrodes 13 other than the applied electrodes are applied with a voltage of 0 V from the ground line 55.

In the ink jet printer head having such an arrangement or mechanism as set forth hereinabove, a protective film 20 is provided to ensure insulation protection of individual electrodes 13 and to prevent the electrodes from being corroded. The protective film 20 is preferably made of an inert inorganic passive state film having an alternately built-up structure of silicon nitride ($SiN_x$) and silicon oxynitride (SiON).

However, the protective film for insulation protection of the electrodes of the ink jet head influences performance of the electrode due to its thickness. The film affects characteristics such as insulation breakdown characteristics, adhesion, stability and the like, and deformation characteristics of jetting ink. If the film thickness is too small, the insulating properties are poor. If the thickness is too large, deformation characteristics are worsened, with attendant drawbacks such as cracks and film separation. The failures of the protective film relate to the stability in quality of the printhead. Since no limitation is placed on the thickness of the protective film in the prior art, the characteristics of the protective film are not uniform. Thus, problems occur in the quality of the printhead causing poor performance with a lowering of yield.

Moreover, in the prior art, no limitation is placed on how to form the protective layer for the coverage. This also leads to failures in head-to-head uniformity of protective film characteristics, quality and stability, resulting in a lowering of yield.

Likewise, no limitation is placed on the type of protective layer in the prior art. This leads to failures in head-to-head uniformity of protective film characteristics, quality and stability, resulting in a lowering of yield.

SUMMARY OF THE INVENTION

It is accordingly a primary object of the invention to provide an ink jet printhead that solves the problems of the prior art.

It is another object of the invention to provide an ink jet head wherein the thickness and/or density of a protective film is defined appropriately, so that the film characteristics are improved to provide an ink jet head with good stable quality, high yield and low cost.

To achieve the above and other objects, an ink jet printer head is provided according to one embodiment of the invention comprising a piezoelectric ceramic element with a plurality of ink reservoirs wherein at least one wall of each reservoir is made of a piezoelectric ceramic material and has an electrode for driving the piezoelectric ceramic element formed on the at least one side wall. The electrode is covered with an inorganic passive state protective film for insulation protection. The protective film has a thickness of from 0.1 μm to a value smaller than ⅛ of a maximum thickness of the at least one wall.

According to another embodiment of the invention, an ink jet printer head comprises a piezoelectric ceramic element having a plurality of ink reservoirs each of which has an electrode for driving the piezoelectric ceramic element formed on each side wall thereof. Each reservoir is covered with an inorganic passive state protective film at all inner surfaces thereof.

According to a further embodiment of the invention, an ink jet printer head comprises a piezoelectric ceramic element with a plurality of ink reservoirs each having an electrode on each side wall thereof covered with an inorganic passive state protective film. The protective film has a density of not smaller than 1.8 g/cm$^3$.

The ink jet head according to the invention has a limited range of the thickness and/or density of an inorganic passive state protective film. The range is limited due to insulation breakdown owing to a smaller thickness of the protective film and deformation characteristics caused by a thicker film. Moreover, if the inner surfaces of the ink reservoirs are covered with the protective film, further improvements can be expected.

DETAILED DESCRIPTION OF PREFERRED EMBODIMENTS OF THE INVENTION

An ink jet printer head according to one embodiment of the invention is described with reference to FIGS. 5 to 8. It is noted that a fundamental arrangement of the ink jet printer head of this embodiment is similar to the known heads shown in FIGS. 1 to 4 and is not further described herein except for the differences from the prior art heads.

The protective film 20, e.g., preferably a $SiN_x$ (silicon nitride) film, is formed on the side walls of each groove 12 of the piezoelectric ceramic plate or element 1 according to a CVD or sputtering process as shown in FIGS. 1 to 4. In this case, x is not critical and is preferably a value of 4/3.

Figure 1:
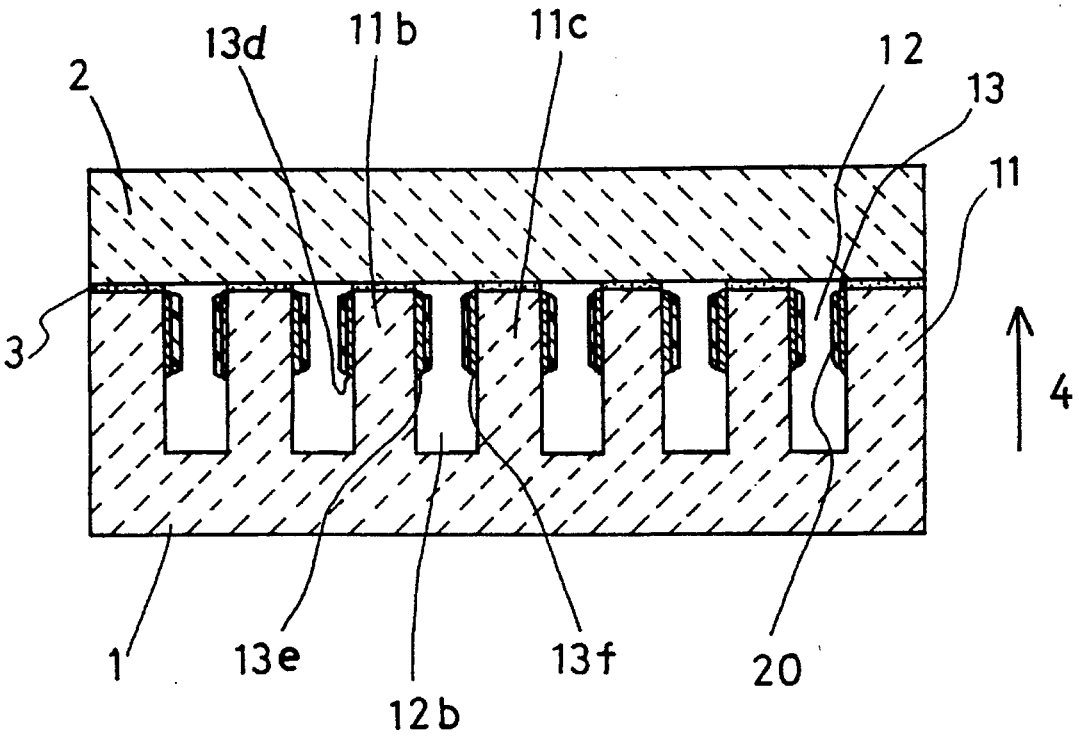
FIG. 1 is a sectional view of a fundamental arrangement of an ink jet printhead of the prior art usable in the present invention.
Figure 2:
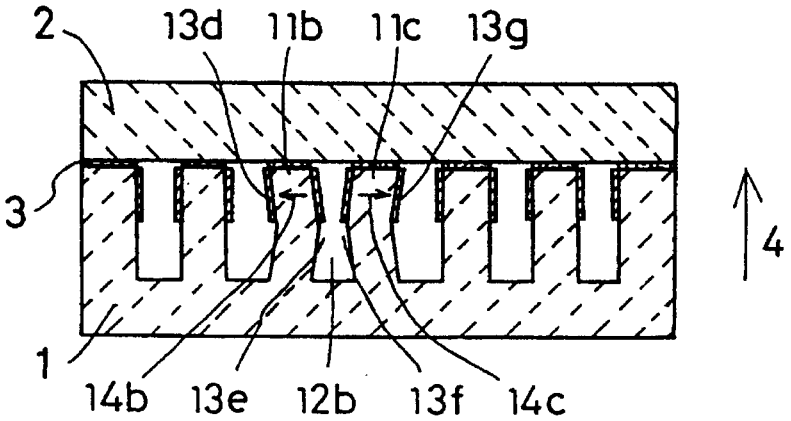
PRIOR ART Fig.2
FIG. 2 is a sectional view of a fundamental arrangement of an ink jet printhead of the prior art usable in the present invention.
Figure 3:
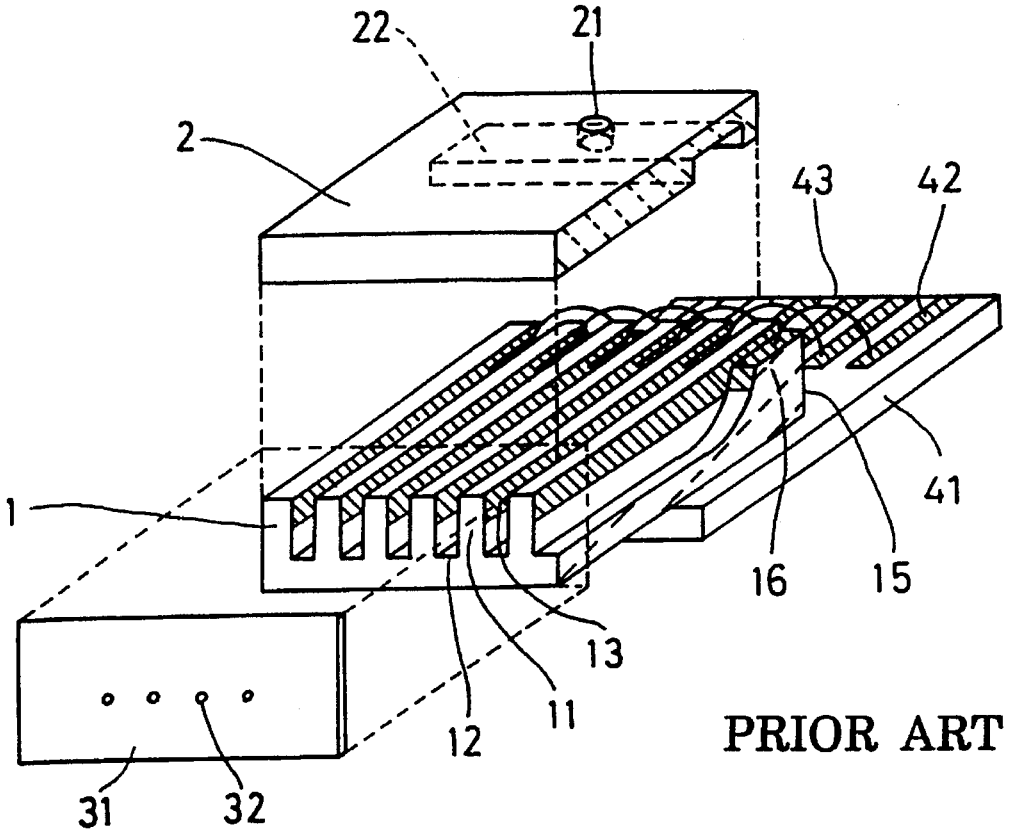
FIG. 3 is an exploded perspective view of an ink jet printhead of the prior art usable in the present invention.
Figure 4:
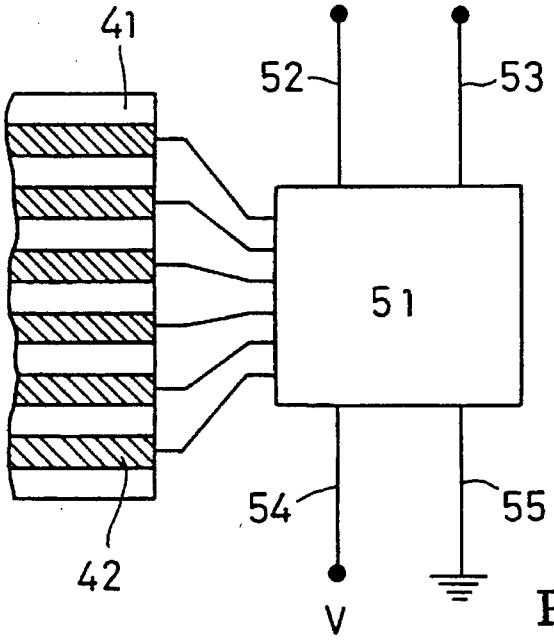
PRIOR ART Fig.4
FIG. 4 is a schematic diagram of a control unit for an ink jet printhead of the prior art usable in the present invention.
Figure 5:
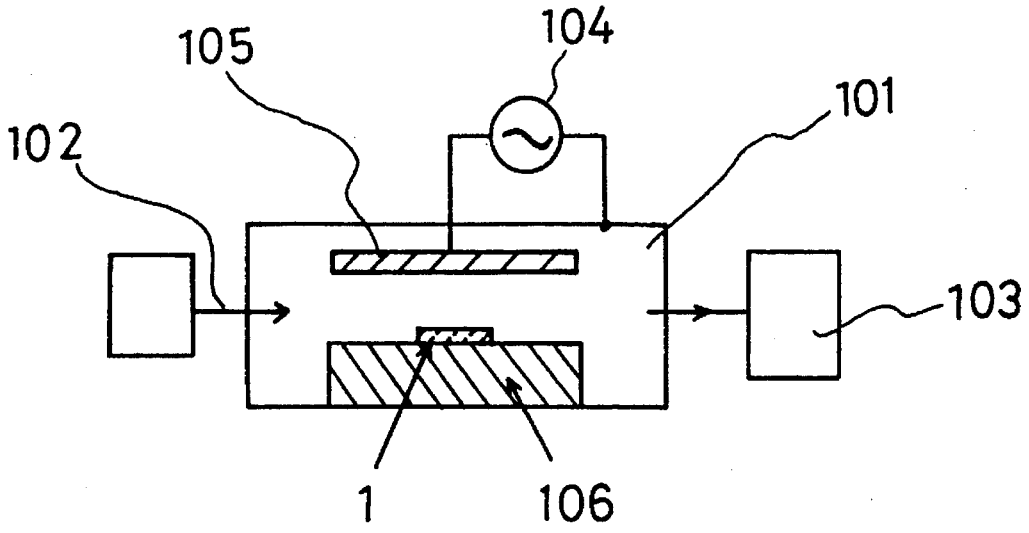
FIG. 5 is a schematic view of a CVD apparatus used to form a protective film according to the present invention.

According to the CVD process, for example, a film-forming apparatus of FIG. 5 is used including a chamber 101, a starting gas introducing pipe 102, an exhaust device 103 and an RF power source 104. The film formation is carried out in the following manner. A power supply electrode 105 and a sample holder 106 are placed in the chamber 101 at a distance of several centimeters from each other. The piezoelectric ceramic plate 1 is placed on the sample holder 106 so that the groove-bearing surface is held facing the power supply electrode, followed by evacuation of the chamber 101 to an extent of 2E-7 Torr.

Subsequently, starting gases, $SiH_4/N_2$ and $NH_3$ and $N_2$, are charged into the chamber from the pipe 102 at rates, for example, of 60 sccm, 180 sccm and 90 sccm (sccm meaning a flow rate per minute, calculated as nitrogen), respectively. While passing the gases, the chamber 101 is maintained at 1.2 Torr, and 0.8 kW is applied to the power supply electrode 105, thereby causing high frequency discharge. As a consequence, the starting gases are converted to chemical active species, thereby causing decomposition and chemical reaction, that is difficult to proceed by ordinary thermal excitation, to take place. For instance, such a chemical reaction is a non-equilibrium reaction as shown in the following formula (1), with which a 1000 angstrom thick $SiN_x$ film is formed on the substrate on discharge over about 3 minutes. It will be noted that the film thickness can be appropriately controlled by controlling the discharge time.

$$(1)\ 3SiH_4+4NH_3 \rightarrow Si_3N_4+12H_2$$

To determine a minimum thickness of the protective film 20, an insulation breakdown test was effected wherein the thickness of the $SiN_x$ film was changed. More particularly, a conductive aluminum film was first formed on a glass substrate according to a known sputtering technique, on which a $SiN_x$ film was formed by the CVD process set out above. Additionally, an aluminum film was further formed on the $SiN_x$ film. A resist was spin coated by use of a spin coater and subjected to contact exposure through a mask having a given pattern. Then, the resist was subjected to dipping development to form a given resist pattern. The given pattern was one wherein the outermost aluminum film was provided as a test electrode and had 20 circles with a diameter of 2 mm arranged in a line at given intervals. This was then followed by immersion in an etching solution for aluminum to etch the aluminum at non-resist portions. Finally, the resist was removed to leave on the surface 20 aluminum circles with a diameter of about 2 mm at given intervals.

In the test samples as set out above, the samples had a thickness of the $SiN_x$ protective film changed to 0.02, 0.04, 0.06, 0.08, 0.10, 0.12 and 0.14 μm. These samples were subjected to measurement of insulation breakdown voltage. More particularly, terminals in the test were, respectively, contacted with the aluminum films present at opposite sides sandwiching the $SiN_x$ film therebetween and applied with a voltage of 100 V. The application was maintained over 1 minute, whereupon insulation breakdown was determined as occurring when a current of 1 μA, which was a minimum scale of an ammeter, was passed. It will be noted that a voltage of 100 V is a value that is several times as high as a possible breakdown voltage necessary as a protective film of an ink jet head of the invention.

Figure 6:
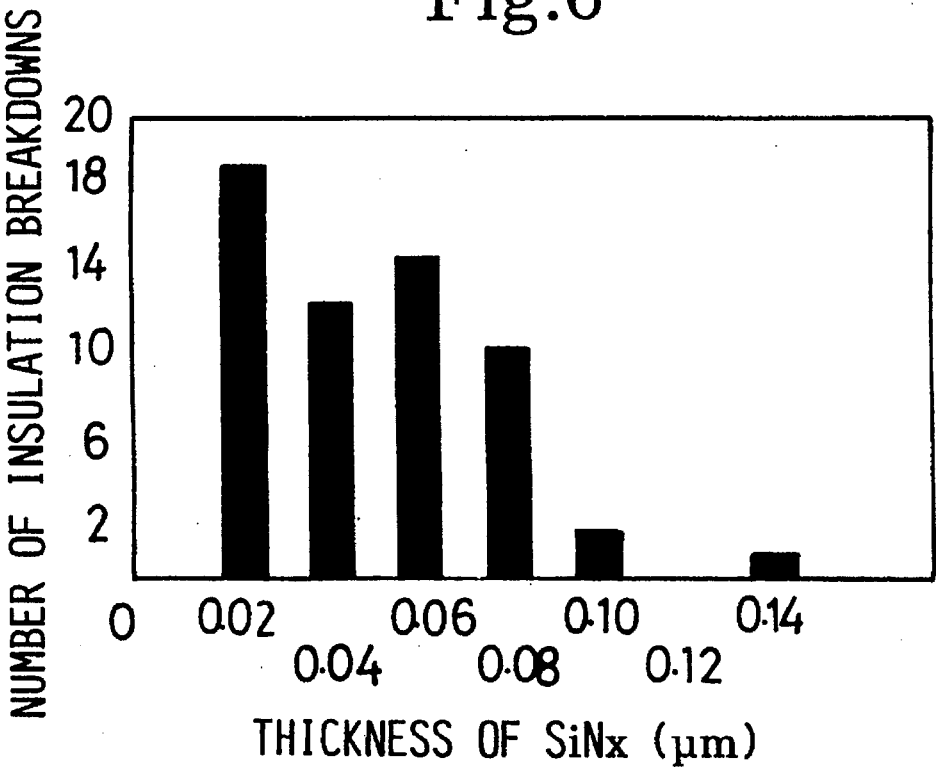
FIG. 6 is a graph showing the relation between the number of insulation breakdowns and the thickness of a protective film according to the invention.

The number of insulation breakdown portions among 20 point electrodes per sample was checked, revealing that, as shown in FIG. 6, when the thickness of the protective film 20 is 0.1 μm or below, the insulation breakdown takes place readily. Worse, when the breakdown takes place, the portion broken down suffers cracks. This creates a very high possibility that the electrode 13 and the PZT material itself will be attacked by the ink.

On the other hand, the $SiN_x$ film was made thick, under which the degree of deformation of the groove walls contributing to ink jetting of the ink jet head was checked. A piezoelectric ceramic substrate having a side wall thickness of 80 μm, a side wall height of 500 μm and a groove width of 90 μm was formed with a 2 μm thick aluminum electrode film at opposite side walls by a dry process such as vacuum deposition to provide a test sample substrate. A protective $SiN_x$ film was formed on the groove walls of the substrate according to the CVD process so that the ratio between the thickness of the $SiN_x$ film and the width of the groove wall was 1/100, 1/25, 1/12 and 1/8, respectively. These samples were each bonded with the cover plate set out hereinbefore, followed by application of a pulse potential of 50 V to measure a degree of deformation of the side walls by a laser displacement meter. It will be noted that since the thickness of the electrode film is much smaller than the thickness of the groove wall, the influence of the electrode film was neglected in considering the deformation of the groove walls.

Figure 7:
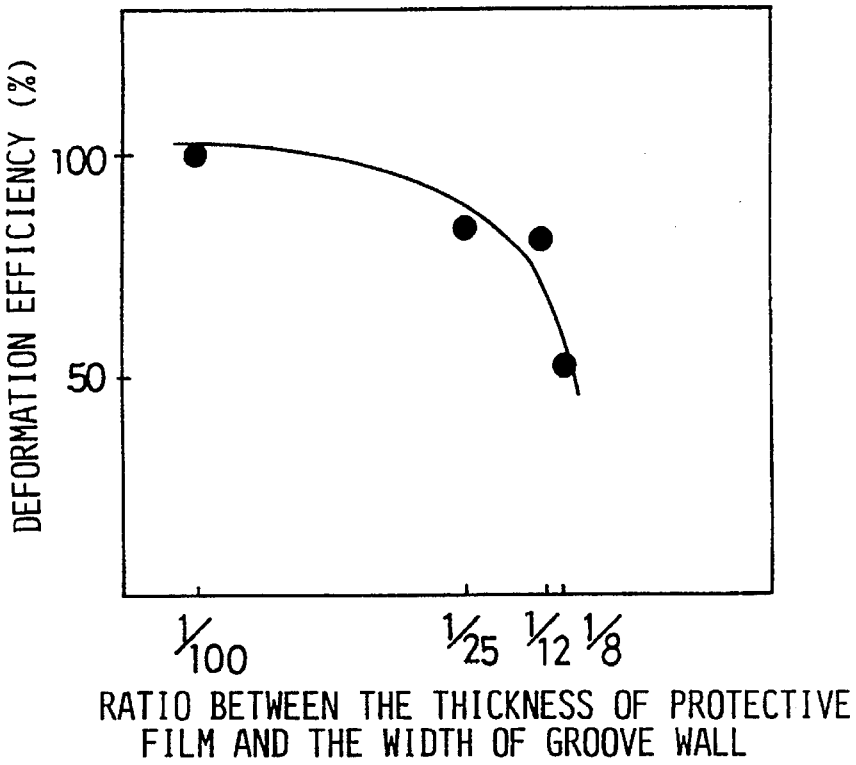
FIG. 7 is a graph showing the relation between the deformation efficiency and the thickness of a protective film according to the invention.

The results of the measurement were expressed as a variation in capacity of adjacent grooves wherein the variation of the capacity of the sample with the ratio of 1/100 was taken as 1. The relation between the film thickness of the respective samples and the rated deformation efficiency is shown in FIG. 7. As is apparent from FIG. 7, with the sample having a ratio between the thickness of the protective film and the dimension of the groove wall of the piezoelectric ceramic of 1/8, the deformation efficiency is significantly lowered. This is because Young's moduli of the piezoelectric ceramic and the $SiN_x$ differ from each other with this difference, the increasing thickness of the protective film significantly influencing the deformation.

The tolerable maximum thickness of the protective film can be regulated from an increase of internal stress. A $SiN_x$ film was formed on a Si wafer by the CVD process to provide samples having the film thicknesses of 2, 4, 6, 8, 10 and 12 μm, respectively. The internal stress of each sample was measured. The measurement was made by measuring the warpage of the Si wafer prior to the film formation by a surface profile analyzer. Then, after the film formation, the warpage at the same portion of the wafer was measured. The internal stress was determined according to the following equation based on the difference between the warpages prior to and after the film formation:

$$(2)\ \sigma=(h^2/6d)\cdot[E/(1-m)]\cdot[2(\Delta y)/R^2]$$

wherein h: thickness of wafer (525 μm; 4 inches);

d: thickness of $SiN_x$ film (ranging from 2 to 12 μm);

m: Poisson's ratio of wafer (0.3);

R: half of the length of an arc determined by measurement of warpage (25 mm; 4 inch);

Δy: maximum variation of warpage at the center of wafer; and

E: Young's modulus of water (1.60E12 dynes/cm$^2$; orientation of crystal (111)).

The values after the parentheses above are those values of a 4 inch long wafer used in this test.

Figure 8:
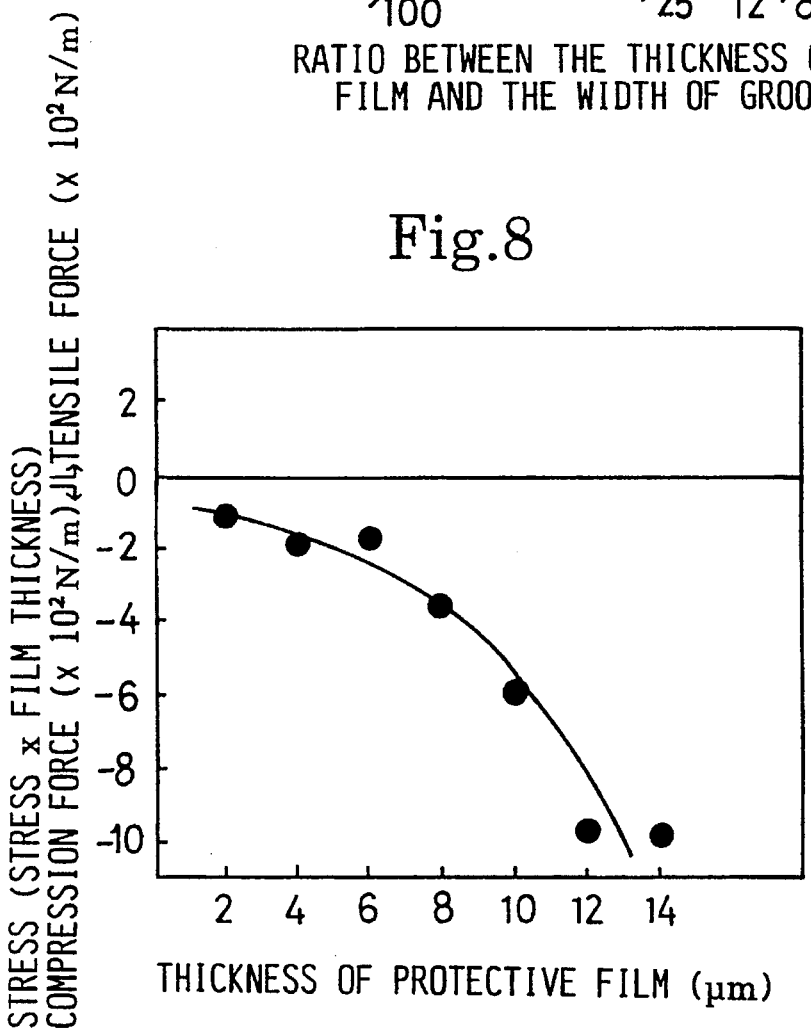
FIG. 8 is a graph showing the relation between the internal stress and the thickness of a protective film according to the invention.

The results of the measurement are shown in FIG. 8, revealing that as the thickness increases, the absolute value of the internal stress of the film tends to increase. Especially, when the thickness of the $SiN_x$ film is 10 μm or over, the stress significantly increases. The film thickness of 10 μm corresponds to a sample whose ratio between the film thickness and the groove wall dimension of the piezoelectric ceramic is 1/8. This film suffered cracks and was partially separated from the underlayer. The cracks and separation were observed through an optical microscope.

The formation of a thicker film takes a prolonged time, thereby causing productivity to be considerably lowered. Although the film-forming speed of the $SiN_x$ film by the CVD process depends on film-forming conditions, it is usually in the range of from 0.01 to 0.05 μm. It should take at least 200 minutes before formation of a 10 μm thick film.

Accordingly, in view of the deformation efficiency, adhesiveness and stability of the protective film, it is preferred that the maximum thickness of the $SiN_x$ film does not exceed ⅛ of the groove wall thickness of the piezoelectric ceramic. This leads to a shortening of the production time, i.e., low costs.

For these reasons, the protective film should have a thickness of from 0.1 μm to a maximum value that does not exceed ⅛ of the ratio between the thickness of the protective film and the groove wall width. By this, the protective film 20 can be obtained at low costs with good protective film properties such as insulating properties, breakdown resistance, adhesiveness and the like and good ink jet characteristics. In fact, using the arrangement of this embodiment, an ink jet head is obtained of high quality having stable ink jet characteristics.

In this embodiment, illustration has been made on a $SiN_x$ film used as the inorganic passive state protective film. When using films of oxides such as $SiO_2$ and SiON, which is a mixture of nitride and oxide, and built-up films of these compounds, a similar tendency as in the results of the measurement was obtained. Accordingly, when these oxides, nitrides or mixtures thereof are used to form a film whose thickness is within the above-defined range, an ink jet head of high quality having stable ink jet characteristics can also be obtained.

The quality of the protective film according to the invention may be controlled not only by controlling the film thickness, but also by controlling another parameter, i.e., a film density. Where, for example, the $SiN_x$ film is formed as the protective film 20 on the grooves 12 of the piezoelectric ceramic plate 1 according to the CVD process set forth hereinbefore, the film density should preferably be not smaller than 1.8 g/cm$^3$. This value is determined, as set forth below, by a pinhole test and measurements of a resistance to buffered hydrofluoric acid (B·HF) and FT-IR (Fourier transform IR spectroscopy) of $SiN_x$ films having different film densities.

More particularly, the pinhole test was effected as follows. A nickel (Ni) film was preliminarily formed on a glass substrate as a conductive film according to a known sputtering technique, followed by forming a 1 μm thick $SiN_x$ film on the Ni film according to the CVD process. By changing forming conditions such as, for example, a gas pressure, a substrate temperature and the like, $SiN_x$ films were formed whose densities were, respectively, 1.5, 1.8 and 2.5. These samples were each washed with an alkali and then with water, and were immersed in a plating bath composed of 40 g/l of copper sulfate and 30 cc/l of sulfuric acid. Each sample was provided as a cathode, and electrolytic copper was provided as an anode at a position away from the cathode at a distance of several centimeters. An electric current having a current density of 1 A/dm$^2$ was passed between the electrodes to carry out electrolytic plating for 30 minutes. Originally, Cu would not deposit on the $SiN_x$ film, which was insulating in nature. However, if pinholes are present in the film, the film becomes electrically conductive causing chemical reaction thereby depositing Cu.

Figure 9:
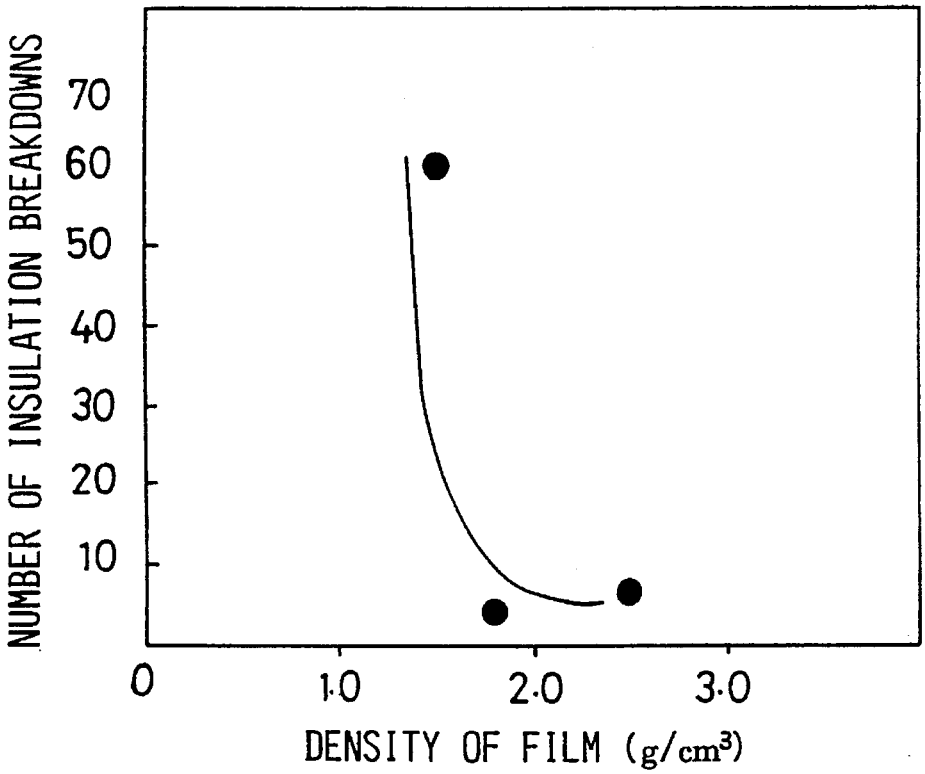
FIG. 9 is a graph showing the relation between the number of Cu deposits and the thickness of a protective film according to the invention.

The results of the pinhole test using a Cu decoration method, wherein Cu deposition caused by the pinholes was observed, are shown in FIG. 9. In the figure, the abscissa axis indicates the density of the film and the ordinate axis indicates the number of Cu deposits observed through an optical microscope in an area of 400 μm$^2$. As will be apparent from FIG. 9, when the films having densities of about 1.5, about 1.8 and about 2.5 g/cm$^3$ are compared with one another, the film whose density is 1.5 is observed to include a number of Cu deposits. With the films having densities of 1.8 and 2.5, there are observed only a small number of deposits, and these are considered to result from dust at the time of film formation.

Figure 10:
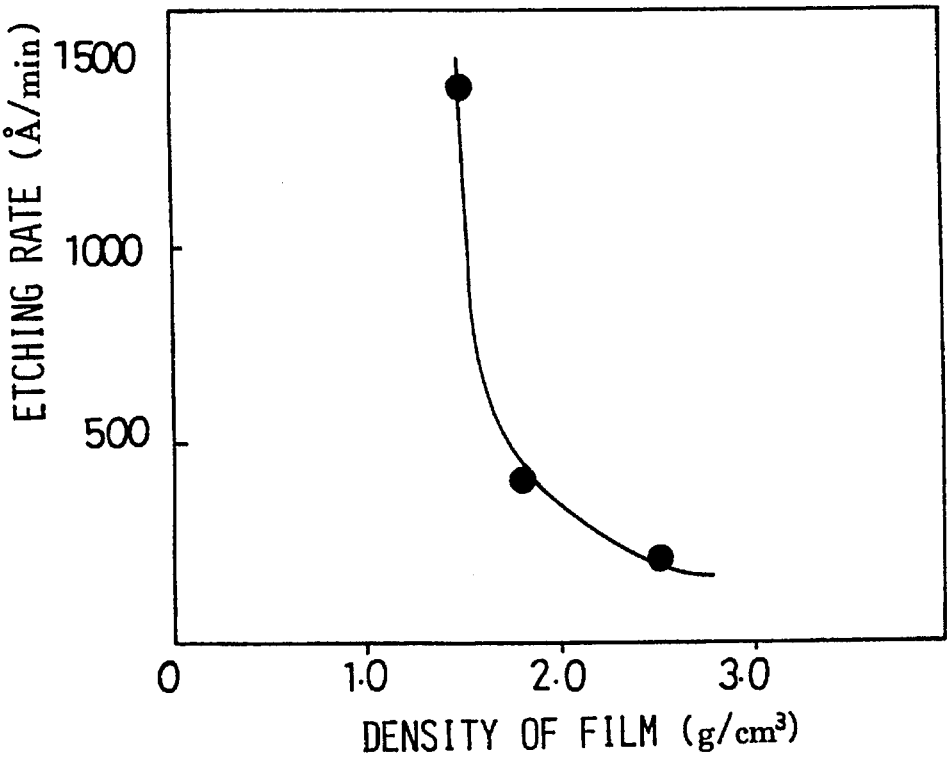
FIG. 10 is a graph showing the relation between the etching rate and the density of a protective film according to the invention.
Figure 11A:
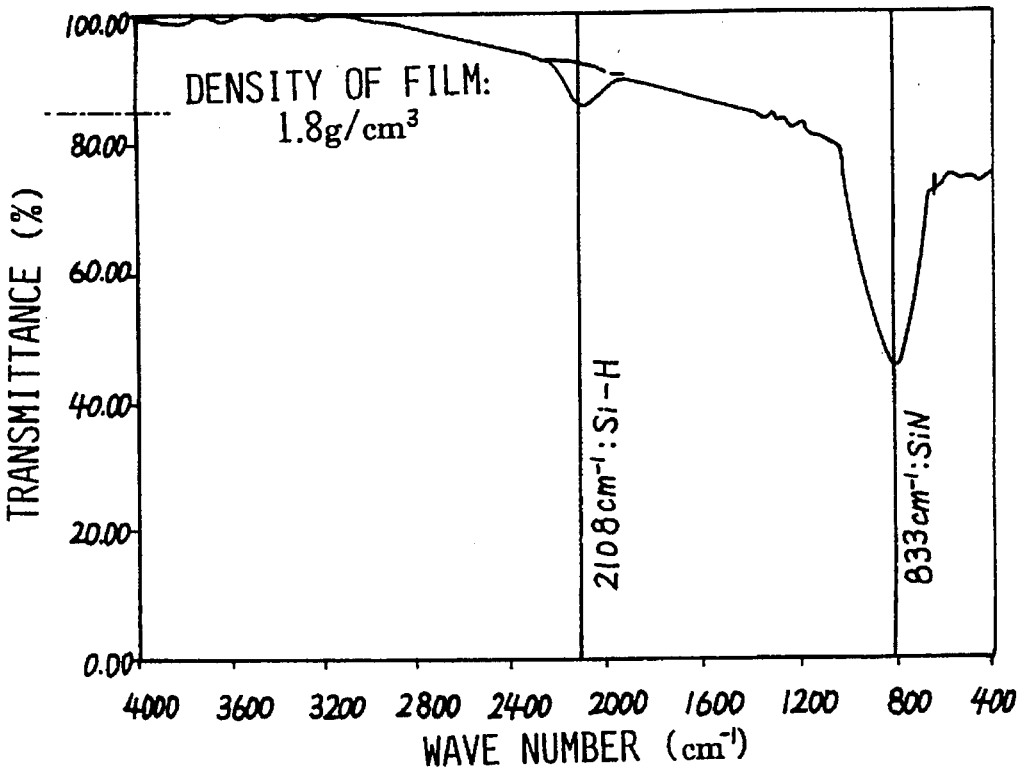
FIGS. 11A and 11B are, respectively, FT-IR charts of a protective film according to the invention.
Figure 11B:
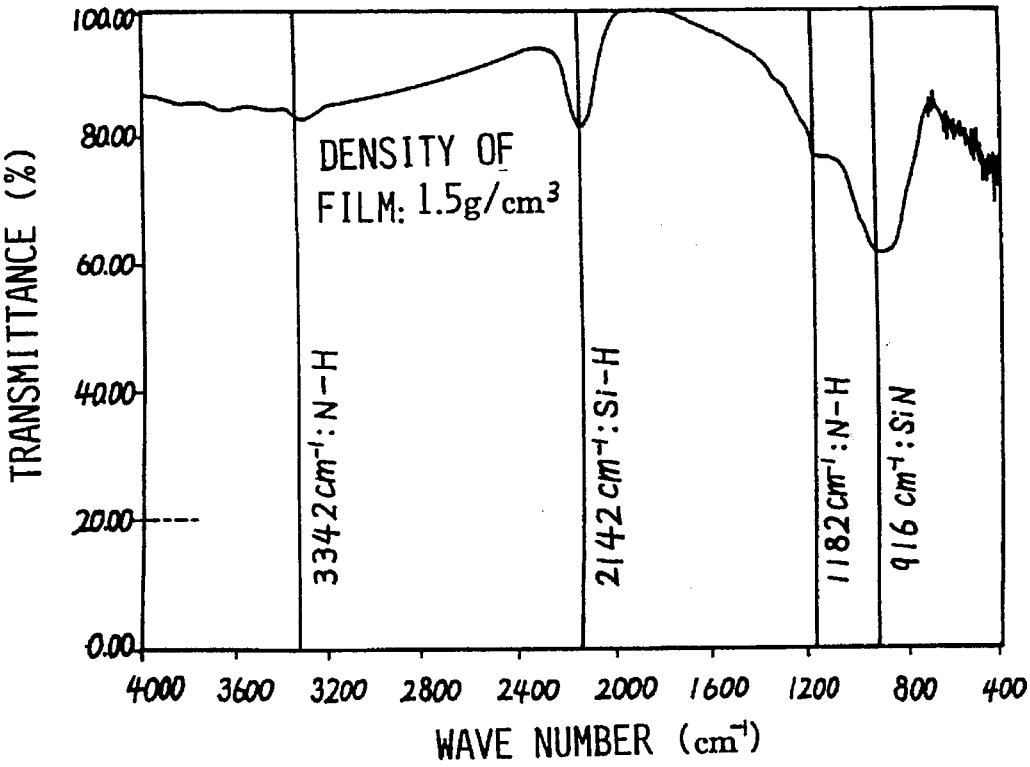

The buffered hydrofluoric acid resistance was evaluated by using a similar sample as in the pinhole test. The sample was immersed in a buffered 1% hydrofluoric acid solution at 24° C. and subjected to measurement of an etching rate per minute. The amount of reduced film was determined by subjecting a stepped portion with the resist covered portion to a surface roughness tester. The results are shown in FIG. 10, from which it will be seen that when the film density is not higher than 1.8, the etching rate becomes large and that when the film density is 1.5, the etching rate amounts to not smaller than 10 times that of a thermal nitride film. With regard to the FT-IR (Fourier transform IR spectroscopy) measurement, a similar sample as used in the pinhole test was subjected to measurement within a range of from 400 to 4000 cm$^{-1}$ (kayser: wave number). The results on the densities of 1.5 and 1.8 are shown in FIGS. 11*a* and 11*b* wherein the abscissa axis indicates the wave number and the ordinate axis indicates a transmittance. According to FIGS. 11*a* and 11*b*, the film having a density of 1.5 is observed to have an absorption peak of the Si-H bond (3340 cm$^{-1}$), which is more conspicuous than that of the film whose density is 1.8, revealing a high content of hydrogen in the film. The larger content of hydrogen means a poorer acid resistance. These results are coincident with those of the measurement of the buffered hydrofluoric acid resistance.

The results of the above test and measurements demonstrate that when the density is smaller than 1.8 g/cm$^3$, the $SiN_x$ film is disadvantageous in that the film undesirably has a number of pinholes and is not dense. Further, the content of hydrogen impurity is in excess, resulting in poor acid resistance.

When the $SiN_x$ protective film has a density of not smaller than 1.8 g/cm$^3$, it becomes possible to form the protective film 20 with only a reduced number of pinholes and a reduced content of impurities and is dense and excellent in acid resistance. Thus, there can be obtained an ink jet printer head of stable quality.

In this embodiment, illustration has been made on a $SiN_x$ film used as the inorganic passive state protective film. When using films of oxides such as $SiO_2$ and SiON, which is a mixture of nitride and oxide, and built-up films of these compounds, a similar tendency as in the results of the afore-stated measurements was obtained. Accordingly, when these oxides, nitrides or mixtures thereof are used to form a film whose density is within the above-defined range, an ink jet head of high quality can also be obtained.

Figure 12:
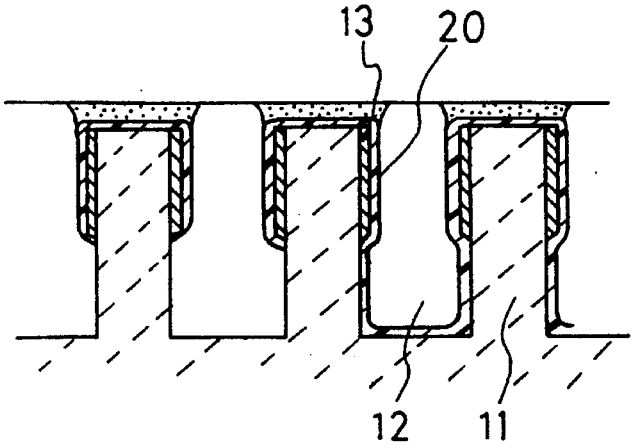
FIG. 12 is a sectional view of an arrangement of an essential part of an ink jet printer head according to the invention.

FIG. 12 shows another embodiment of the invention wherein the protective film is formed over the entire inner walls of the grooves 12. In the foregoing embodiments, the protective film is formed to cover the electrode therewith. In order to more effectively prevent the electrode films from being corroded and to improve jetting characteristics, the $SiN_x$ film is formed on all the inner surfaces of each groove 12, as is particularly shown in FIG. 12. This is proven based on the results of the following test and measurements.

The protection characteristics of the protective film were assessed by measuring a degree of corrosion of an electrode in an corrosive environment and by measuring the variation in specific resistance of an electrode film in an accelerated environment. The corrosion test was conducted according to a polarization measuring method using a well known potentiostat. The sample was a ceramic substrate provided with ten grooves, each having a side wall thickness of 80 μm, a height of 500 μm and a groove width of 90 μm. Aluminum (Al) was vacuum deposited on each side wall as an electrode film. The ceramic substrate was then subjected to the CVD process wherein film-forming conditions, particularly the deposition pressure, were appropriately controlled so that the protective film was formed on the half of the walls of the grooves 12, i.e., the electrode alone was covered with the protective film in this case (electrode coverage). Further, to improve the step coverage, the protective film was continuously covered throughout the inner walls of the grooves 12 (continuous coverage) for another sample. In both cases, the protective film was formed in an average thickness of 0.2 μm. The two types of samples were each placed in a 0.1N aqueous sodium chloride solution. In the solution, Pt was provided as a counter electrode and silver/silver chloride (Ag/AgCl) was provided as a reference electrode in such a way that the electrodes were kept away from each other at a distance of several centimeters. Then, a potential was gradually applied to the electrodes covered with the respective protective films to measure how the electric current was passed at the sample electrodes.

Figure 13:
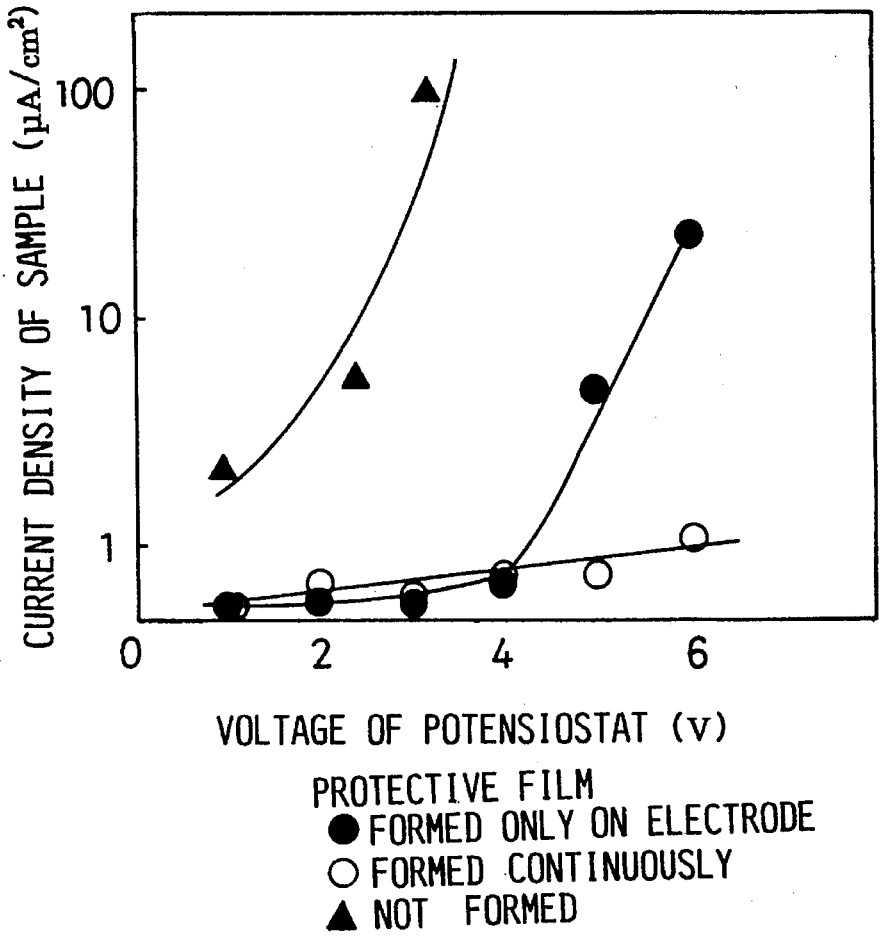
FIG. 13 is a graph showing a polarization characteristic of an electrode film using a protective film according to the invention.

The results are shown in FIG. 13, revealing that with the sample whose protective film covers the electrode alone, an electric current starts to be passed abruptly at a certain potential. Thus, the protective film is deteriorated and the electrode metal film starts to be corroded. On the other hand, with the sample having the continuous cover film, little or no current rise is found as in the former sample. This is because when the sample having the protective film formed only on the electrode an end face of the protective film is exposed at the boundary thereof, and the corrosive solution enters from the end face, thereby causing the metal electrode film to be corroded. More particularly, with the sample whose protective film is formed only on the electrode, the function of the protective film against the stimulation from the corrosive environment is so poor that the corrosion of the electrode film is liable to proceed. On the other hand, it will be appreciated that the continuous coverage having no end face is better in the protective film function against the corrosive environment. In addition, it will be seen that when any protective film is not formed, the current starts to pass immediately after application of the voltage, resulting in immediate corrosion.

For the accelerated environmental test, samples as used in the corrosion test were used and exposed to an environment of a temperature of 60° C. and a humidity of 90% for 30 days, followed by determination of a variation in specific resistance of the metal electrode film covered with the protective film. It was found that with the sample whose protective film was formed only on the electrode, the specific resistance was increased to about 1.5 times higher. Whereas, with the continuous coverage sample, the specific resistance was increased only slightly to 1.1 times higher. The reason why the specific resistance is increased to 1.5 times higher is because excess moisture enters from the end face of the protective film and oxidizes part of the electrode film. In general, the ink jetting in ink jet printers is ascribed to the deformation of the walls. From an electrical aspect, the charge and discharge phenomena of capacitor occurs to establish the equation, $\gamma=cR$, wherein $\gamma$ is a time constant, C is an electrostatic capacitance of the side walls, and R is a specific resistance of the electrode. For the ink jetting, abrupt deformation should take place, i.e., $\gamma$ should be a value which is not larger than a certain level. The increase of R results in an increase of $\gamma$, which is disadvantageous in view of ink jetting. It will be seen that, like the results of the corrosion test, the formation of the continuous protective film is better than the formation of the protective film only on the electrode film. From the above tests, it is necessary that the protective film be deposited at least on the electrode. Preferably, the protective film should be formed continuously, entirely covering the inner walls of the grooves 12 therewith. By this arrangement, the protective film 20 becomes resistant to stimulation from the outside, exhibits a good corrosion resistance, and brings about good jetting characteristics.

When an ink jet printer head makes use of a continuous coverage protective film of this embodiment, it has good durability and stable jetting characteristics.

Like the foregoing embodiments, illustration has been made with a $SiN_x$ film used as the inorganic passive state protective film in this embodiment. When using films of oxides such as $SiO_2$ and SiON, which is a mixture of nitride and oxide, and built-up films of these compounds, a similar tendency occurs as in the results of the foregoing embodiments. Accordingly, when these oxides, nitrides or mixtures thereof are used to form a film that covers the entire inner walls of grooves, there can be obtained an ink jet head of high quality.

As will be apparent from the foregoing, when using an inorganic passive state film as a protective film of an ink jet head wherein the film thickness is in the range of from 0.1 μm to a value corresponding to a ratio between the thickness of the protective film and the groove wall width of smaller than ⅛, a protective film is formed that can prevent insulation breakdown from occurring as caused in smaller thicknesses. Further, protective film in this range can suppress an undesirable internal stress caused in a larger thickness, resulting in good adhesion. In addition, since the formation time can be shortened, good productivity is ensured. In other words, a protective film having good insulating properties, adhesion and other protection characteristics can be formed in high productivity. Thus, an ink jet head with good stability in product quality can be supplied at low cost.

Certain modifications and changes to the invention will be apparent to those skilled in the art. The description herein is not intended to be limiting to the invention as defined in the appended claims.

What is claimed is:

1. An ink jet printer head comprising:

a channel plate having a plurality of upstanding spaced walls made of piezoelectric material defining ink channels therebetween, said walls having opposed sides and a thickness;

electrodes coupled to said opposed sides of said walls of said channel plate, said electrodes adapted to receive voltage to deform said walls to cause ink in said channels to be ejected therefrom; and an inorganic passive state protective film formed on at least said electrodes, said protective film having a thickness of not less than 0.1 μm and not greater than ⅛ of said thickness of each of said walls of said channel plate.

2. The ink jet printer head of claim 1 wherein said protective film is made from a material selected from the group consisting of $SiN_x$, oxides of Si, SiON and mixtures thereof, wherein x is a quantity of N present for every unit of Si.

3. The ink jet printer head of claim 2 wherein said protective film is made of $SiN_x$ and x is 4/3.

4. The ink jet printer head of claim 1 wherein said protective film is formed on said electrodes by chemical vapor deposition.

5. The ink jet printer head of claim 1 wherein said protective film is formed on said electrodes by sputtering.

6. The ink jet printer head of claim 1 wherein said electrodes are made of aluminum.

7. The ink jet printer head of claim 1 wherein said protective film is formed over said electrodes and said ink channels, said protective film completely covering said ink channels.

8. The ink jet printer head of claim 1 wherein said protective film has a density of at least 1.8 g/cm$^3$.

9. An ink jet printer head comprising:

a channel plate having a plurality of upstanding spaced walls of piezoelectric material defining a plurality of generally parallel elongated ink channels therebetween, each ink channel having a bottom and said walls having opposed sides;

electrodes coupled to said opposed sides of said walls of said channel plate, wherein at least a portion of one of said bottom of each of said ink channels and each said side wall associated with said ink channel does not have an electrode formed thereon, said electrodes adapted to receive voltage to deform said walls to cause ink in said channels to be ejected therefrom; and an inorganic passive state protective film formed over said electrodes and substantially entirely covering said ink channels defined in said channel plate, including covering said at least one portion of one of said bottom of each of said ink channels and each said side wall associated with said ink channel without said electrode formed thereon, wherein said protective film has a thickness in a range of not less than 0.1 μm and not greater than ⅛ of a thickness of each of said walls of said channel plate, and has a density of at least 1.8 g/cm$^3$.

10. The ink jet printer head of claim 9 wherein said walls of said channel plate are made of piezoelectric material.

11. The ink jet printer head of claim 9 wherein said protective film is made from a material selected from the group consisting of $SiN_x$, oxides of Si, SiON and mixtures thereof, wherein x is a quantity of N present for every unit of Si.

12. The ink jet printer head of claim 11 wherein said protective film is made of $SiN_x$ and x is 4/3.

* * * * *